US005598937A

United States Patent [19]

Clark

[11] Patent Number: 5,598,937

[45] Date of Patent: Feb. 4, 1997

[54] SLACKLESS DRAWBAR ASSEMBLY

[75] Inventor: Marlin E. Clark, Dover, Pa.

[73] Assignee: Keystone Industries, Inc., Camp Hill, Pa.

[21] Appl. No.: 601,180

[22] Filed: Feb. 14, 1996

[51] Int. Cl.[6] ..... B61G 9/20

[52] U.S. Cl. ..... 213/62 R; 213/50; 213/75 R; 29/446

[58] Field of Search ..... 213/45, 47, 48, 213/50, 62 R, 67 R, 69, 75 R, 59, 61, 62 A, 64, 72; 267/3, 257, 294; 29/428, 446

[56] References Cited

U.S. PATENT DOCUMENTS

| | | | |
|---|---|---|---|
| Re. 33,985 | 7/1992 | Glover | 213/71 |
| 2,318,472 | 5/1943 | Dwyer, Jr. et al. | 213/59 |
| 2,576,214 | 11/1951 | Danielson | 213/48 |
| 2,640,602 | 6/1953 | Willison et al. | 213/45 |
| 2,640,603 | 6/1953 | Willison et al. | 213/45 |
| 2,686,602 | 8/1954 | Willison | 213/46 |
| 2,686,667 | 8/1954 | Willison et al. | 267/1 |
| 2,832,476 | 4/1958 | Metzger | 213/19 |
| 2,850,179 | 9/1958 | Nystrom et al. | 213/62 |
| 2,889,056 | 6/1959 | Blattner | 267/294 |
| 2,990,962 | 7/1961 | Nystrom | 213/62 |
| 2,990,963 | 7/1961 | Kulieke | 213/62 |
| 3,185,317 | 5/1965 | Willison | 213/45 |
| 3,414,135 | 12/1968 | Levie | 213/45 |
| 3,637,088 | 1/1972 | Bremond | 213/45 |
| 3,856,153 | 12/1974 | Cope | 213/67 A |
| 4,111,406 | 9/1978 | Zanow | 267/153 |
| 4,230,228 | 10/1980 | Kaim | 213/62 A |
| 4,258,628 | 3/1981 | Altherr | 105/4 R |
| 4,422,557 | 12/1983 | Altherr | 213/62 R |
| 4,456,133 | 6/1984 | Altherr et al. | 213/62 R |
| 4,506,868 | 3/1985 | Shiroyama et al. | 267/3 |
| 4,531,648 | 7/1985 | Paton | 213/50 |
| 4,545,304 | 10/1985 | Brodeur et al. | 105/3 |
| 4,549,666 | 10/1985 | Altherr et al. | 213/62 A |
| 4,555,033 | 11/1985 | Miller | 213/51 |
| 4,573,594 | 3/1986 | Kunst et al. | 213/51 |
| 4,580,686 | 4/1986 | Elliott | 213/62 A |
| 4,589,558 | 5/1986 | Brodeur et al. | 213/50 |
| 4,593,827 | 6/1986 | Altherr | 213/50 |
| 4,681,040 | 7/1987 | Brodeur et al. | 213/62 R |
| 4,700,853 | 10/1987 | Altherr et al. | 213/50 |
| 4,700,854 | 10/1987 | Chadwick | 213/62 R |
| 4,776,474 | 10/1988 | Terlecky et al. | 213/64 |
| 4,848,611 | 7/1989 | Terlecky et al. | 213/64 |
| 4,946,052 | 8/1990 | Kaim et al. | 213/75 R |
| 4,949,856 | 8/1990 | Solomon | 331/49 |
| 4,966,291 | 10/1990 | Glover | 213/71 |
| 5,000,330 | 3/1991 | Kaim et al. | 213/62 R |
| 5,002,192 | 3/1991 | Kaufhold | 213/61 |
| 5,005,715 | 4/1991 | Solomon | 213/62 A |
| 5,042,393 | 8/1991 | Kanjo et al. | 105/3 |

(List continued on next page.)

OTHER PUBLICATIONS

Keystone Railway Equipment Co., Keystone Draft Gear Model NC–496 (Drawing No. SB–44481), Feb. 12, 1992.

Keystone Railway Equipment Co., Keystone Mini–Gear Model 495–4A (Drawing No. B–16560), Aug. 10, 1995.

V. Terrey Hawthorne and Anthony R. Hratt, ASME Publication "Progress Report–Slackless Drawbar Testing", Apr./May 1992, pp. 61–67.

S. K. Punmani and F. D. Irani, Railway Age Publication "Preload Enhancing Cushioning" May 1995, pp. 55–61.

*Primary Examiner*—S. Joseph Morano

*Attorney, Agent, or Firm*—Thomas Hooker, P.C.

[57] ABSTRACT

A slackless drawbar assembly joining railcars includes a drawbar, each end of the drawbar being joined to a yoke surrounding a cushioning unit and a follower block confined between forward and rear stops in a conventional sill pocket. The cushioning unit includes a front plate, an elongate spacer block and a compressed stack of elastomer pads sandwiched between the plate and block. Tightening wedges and shims are not used. The compressed pad stock holds the cushioning unit between the stops with a preload of about 50,000 pounds to prevent binding between the drawbar and the follower plate from causing derailments. The preload also holds the cushioning unit tight in the pocket.

26 Claims, 3 Drawing Sheets

U.S. PATENT DOCUMENTS

| | | | |
|---|---|---|---|
| 5,054,630 | 10/1991 | Altherr | 213/56 |
| 5,080,242 | 1/1992 | Steffen et al. | 213/62 R |
| 5,096,075 | 3/1992 | Glover | 213/61 |
| 5,105,955 | 4/1992 | Hawryszkow et al. | 213/75 R |
| 5,131,548 | 7/1992 | Chi | 213/64 |
| 5,172,818 | 12/1992 | Mautino et al. | 213/62 R |
| 5,190,173 | 3/1993 | Mautino et al. | 213/62 R |
| 5,193,699 | 3/1993 | Kaufhold et al. | 213/75 R |
| 5,207,718 | 5/1993 | Glover et al. | 213/62 R |
| 5,221,015 | 6/1993 | Mautino et al. | 213/67 R |
| 5,246,135 | 9/1993 | Radwill | 213/64 |
| 5,312,007 | 5/1994 | Kaufhold et al. | 213/75 R |
| 5,320,229 | 6/1994 | Mautino et al. | 213/67 A |
| 5,339,970 | 8/1994 | Mautino et al. | 213/67 R |
| 5,360,124 | 11/1994 | Wurzer et al. | 213/75 R |
| 5,360,125 | 11/1994 | Dawson et al. | 213/75 R |
| 5,415,304 | 5/1995 | Hanes et al. | 213/50.5 |

SLACKLESS DRAWBAR ASSEMBLY

FIELD OF THE INVENTION

The invention relates to a slackless drawbar assembly for connecting railcars.

DESCRIPTION OF THE PRIOR ART

Railcars are typically joined to one another by automatic knuckle-type couplers. These couplers provide a degree of slack between adjacent railcars which permits the cars to rotate relative to each other as they move around horizontal and vertical curves. However, the slack inherent in automatic knuckle-type couplers permits the cars to move toward or away from each other and subjects the cars to large inertial loadings when the slack is taken up, particularly in long trains. These loadings increase along the length of the train and can frequently become sufficiently large to damage lading. Inertial loadings inherent in moving coupled railcars through a hump yard may also be sufficiently large to injure lading.

Draft gears are conventionally provided between couplers and railcars in order to absorb energy to cushion shocks. These gears normally have a relatively long travel of about 3¼ inches which, when added to the typical 1 inch slack in knuckle couplers, permits the build-up of relatively large velocities between adjacent cars and consequential large train action impacts.

In an attempt to reduce train action and damage to lading, railroads have searched for ways to reduce car-to-car movement or slack in trains. One approach which has been used to reduce slack is to connect two adjacent railcars directly together using a slackless drawbar. A solid drawbar replaces the pair of couplers and is permanently attached to adjacent cars. Use of a drawbar completely eliminates the 1 inch of knuckle-coupler slack. When a slackless drawbar is used it is also necessary to eliminate the relatively large slack provided by conventional draftgear travel.

Rigid connections between the drawbars and the railcars were tried but found to be unsatisfactory. Some resiliency in the drawbar-to-railcar connection is required in order to prevent binding between the drawbar and the car when the connection was exposed to high buff and draft loadings. If no resiliency is provided, these loadings can bind the drawbar to the car and increase the lateral/vertical (L/V) force ratio for the car sufficiently to cause a derailment.

Derailments are caused when the force holding one end of a railcar down on the tracks is insufficient to prevent the wheels on the end of the car from climbing up the inside rail. The likelihood of a derailment is indicated by the lateral/vertical (L/V) force ratio where L is the lateral force on the end of the railcar and V is the vertical force holding the wheels down on the track. Any increase in the L/V ratio increases the risk of derailment. Resilent connections between a slackless drawbar and the joined railcars are now a recognized requirement for successful slackless drawbar coupling. There connections minimize increase in the value of L and decrease in the value of V due to binding sufficient to increase the value of L/V and risk derailment.

Slackless drawbar couplings join standard railcars manufactured with sills and standard Association of American Railroads (AAR) specification draftgear pockets. The pockets are designed to accommodate long travel draftgears of the type conventionally used with knuckle-type automatic couplers. The cushioning units used in conventional slackless drawbar assemblies include cushion pad stacks shorter than the pad stacks used in the conventional draftgears, a metal spacer block to elongate the cushioning unit and fill the standard AAR pocket and shims. Standard yokes and follower blocks are used. The gears used in slackless drawbar assemblies also include a gravity drop wedge that works against an inclined block.

A drop wedge is used to maintain the length of a conventional cushioning unit and compensate for wear between the various components of the unit. Wedges also compensate for separation of the front and rear stops, called sill stretch. The wedge is designed to fall down to maintain the unit tight in the pocket despite component wear and sill stretch so that the drawbar-railcar connection is slackless during a long service life.

U.S. Pat. No. 5,360,125 discloses a slackless drawbar assembly using a gravity drop wedge-type cushioning unit. This type of unit was manufactured and sold by Keystone Industries, Inc., of Camp Hill, Pa., assignee of the present invention.

Problems were encountered with wedge-type slackless drawbar assemblies of the type shown in U.S. Pat. No. 5,360,125. The cushioning units of these assemblies include a wedge, an inclined block, additional metal blocks and plates, and machined shim plates required to fit the cushioning units in AAR pockets. Manufacture of these separate parts is expensive.

Installation of wedge-type cushioning units requires an inventory of shims and shimming of each cushioning unit to fit a particular draftgear pocket. This is a difficult and time consuming process.

Further, in practice, wedge-type cushioning units used in slackless drawbar assemblies do not always Work as intended. Sometimes the wedge works up in the pocket thereby loosening the cushioning unit and providing undesired slack. Sometimes the wedge works down in the pocket in response to high buff or draft loadings and sill stretch, resulting in a very tight cushioning unit in the pocket with a high reaction force. Tight cushioning units did not possess the low reaction force or resilience needed to permit the rough-cast surfaces on the drawbar butts to rotate past the complementary rough-cast surfaces on follower blocks. Instead of rotating, the surfaces bind or lock together, running the risk that the lateral/vertical force ratio for an empty railcar could be increased sufficiently that the wheel flanges climb over a rail and cause a derailment. Derailments are particularly likely in trains of light, unloaded railcars joined by tight wedge-type slackless drawbar assemblies which are subjected to high buff or draft loadings.

Further problems are experienced with wedge-type cushioning units used in slackless drawbar assemblies. These cushioning units include a number of stacked parts which are confined in the pocket between the front and back pocket stops. Repeated lateral loading of these units, due to horizontal curving, can cause the parts to shift laterally in the pocket. This shifting can make disassembly of the various parts from the pocket difficult.

SUMMARY OF THE INVENTION

The invention is an improved slackless drawbar assembly including an elongate slackless drawbar and like draftgear joining each end of the drawbar to a railcar. Each draftgear is fitted in an AAR-type draftgear pocket formed in the sill of a railcar to be coupled by the assembly. Each draftgear includes a yoke, a cushioning unit a follower block, and a coupler pin to join the yoke to the drawbar. The cushioning unit is of improved design including a spacer block, a short stack of resilient elastomer pads and a front plate. Bolts hold the pad stack between the block and plate. Wedges and spacer plates are not used.

The cushioning units are assembled and gagged in a collapsed position to facilitate free movement with the follower blocks into the sill pockets between front and rear stops. Support plates are then bolted to the bottom of the sill to hold the assemblies in place. Coupler pins are inserted to attach each end of the slackless drawbar to the ends of the yokes and complete installation of the slackless drawbar assembly in the two adjacent railcars.

Initial buff or draft loadings collapse the cushioning units sufficiently to permit the gags to fall away so that the cushioning units then expand against the front and back stops with a low reaction force in the pocket of about 50,000 pounds. The reaction force holds the cushioning units tight in place in the pockets despite variations in the lengths of the pockets due to manufacturing tolerances or sill stretch.

The wedgeless and unshimmed cushioning units assure that the connections between the slackless drawbar and the railcars are maintained tight during the service life of the draftgear and prevent derailments of light or empty railcars connected in a train. The wedgeless cushioning unit of the present invention has a relatively low initial reaction force which permits the follower block to move away from the butt end of the drawbar during high loading which could otherwise bind two parts together, increase L or decrease V and cause a derailment.

Elimination of shims, the wedge and wedge reaction member reduces the cost of manufacture and installation of the assembly. Further, the pad stack has a long useful life, assuring that the assembly is tight within the stops and maintains slackless performance during useful life of the assembly. The cushioning units are easily removed from the pockets.

Other objects and features of the invention will become apparent as the description proceeds, especially when taken in conjunction with the accompanying drawings illustrating the invention, of which there are three sheets and one embodiment.

DESCRIPTION OF THE PREFERRED EMBODIMENT

Figure 2:
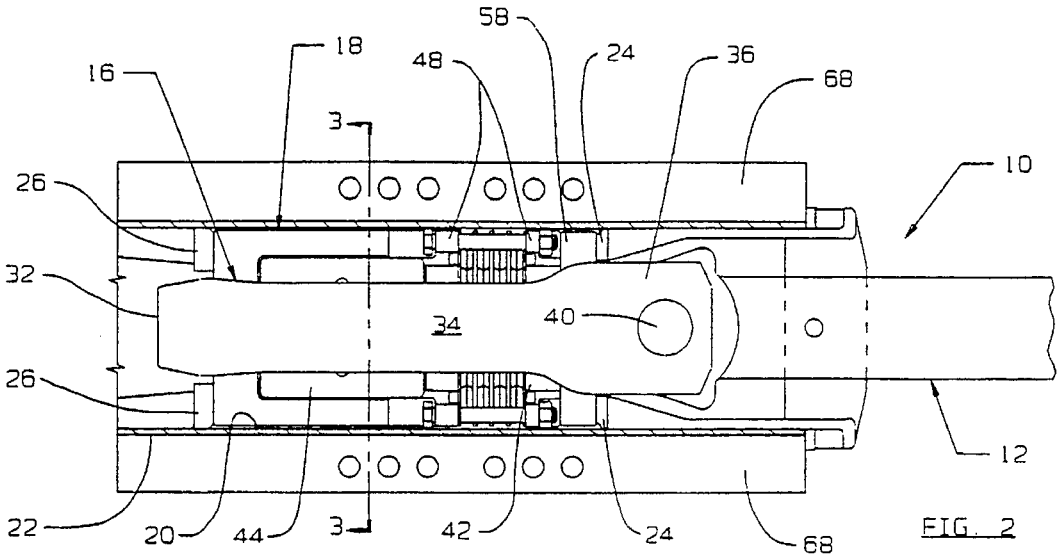
FIG. 2 is a sectional view taken generally along line 2—2 of FIG. 1.

Slackless drawbar assembly 10 includes an elongate rigid drawbar 12 having opposed butt ends 14 (only one is illustrated) each connected to a conventional yoke 16 which surrounds a specialized cushioning unit 18 and follower block 58. The yoke, cushioning unit and block at each end of the assembly are identical. Only one end of assembly 10 is illustrated and described.

Unit 18 and blocks 58 are positioned in a conventional draft gear pocket 20 located in the end of the sill 22 of one of the railcars coupled by assembly 10. The cushioning unit and block are confined between front stops 24 and rear stops 26 mounted on the sidewalls of the sill.

Each butt end of drawbar 12 includes a vertical pin aperture 28 and a generally spherical surface 30 on the end of the bar. Surface 30 is rough-cast and is not smoothed or machined. Yoke 16 includes a heel 32 located adjacent rear stops 26 and a pair of straps 34 extending from the heel to ends 36 located to either side of the end of the drawbar. Bores 38 are formed through the yoke arm ends 36 and coupler pin 40 is fitted in the bores 38 and extends vertically through pin aperture 28. The pin 40 secures the ends of the drawbar 12 to yoke 16. Aperture 28 is larger than pin 40 to permit the drawbar to pivot on the pin in a vertical plane. The yoke is fitted between the pairs of stops 24 and 26 and extends the length of pocket 20.

Figure 4:
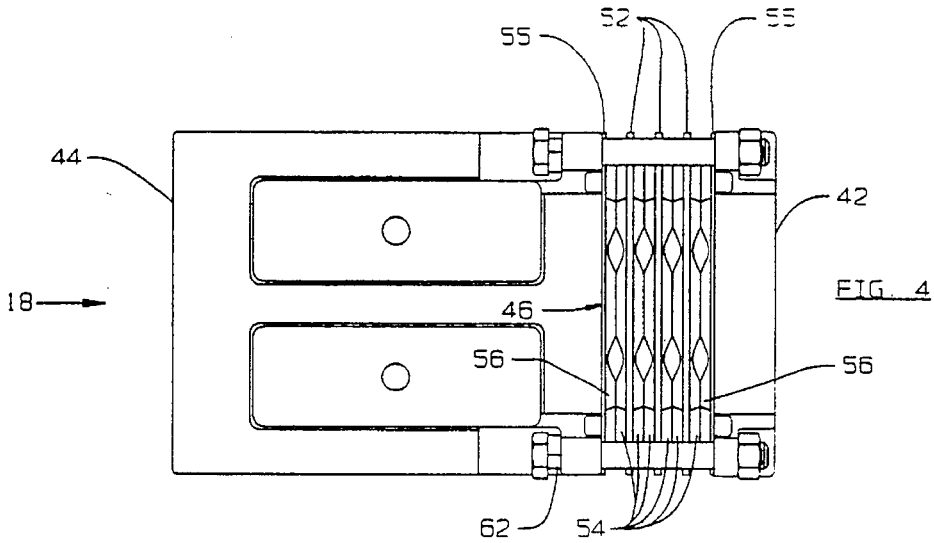
FIGS. 4 and 5 are top and side views respectively of a cushioning unit used in the slackless drawbar assembly.
Figure 5:
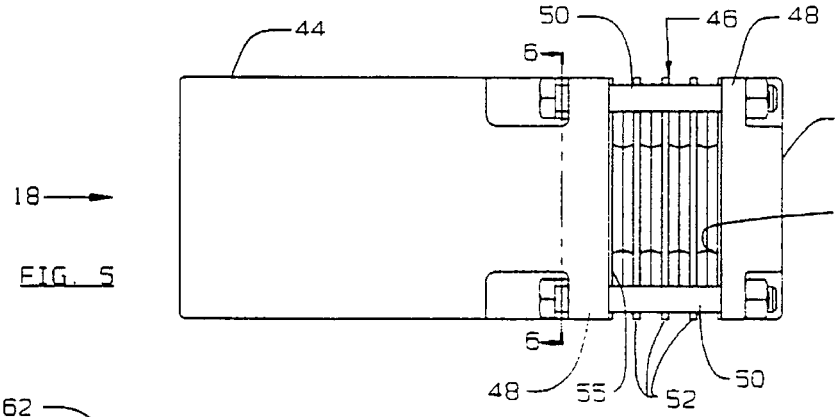
Figure 6:
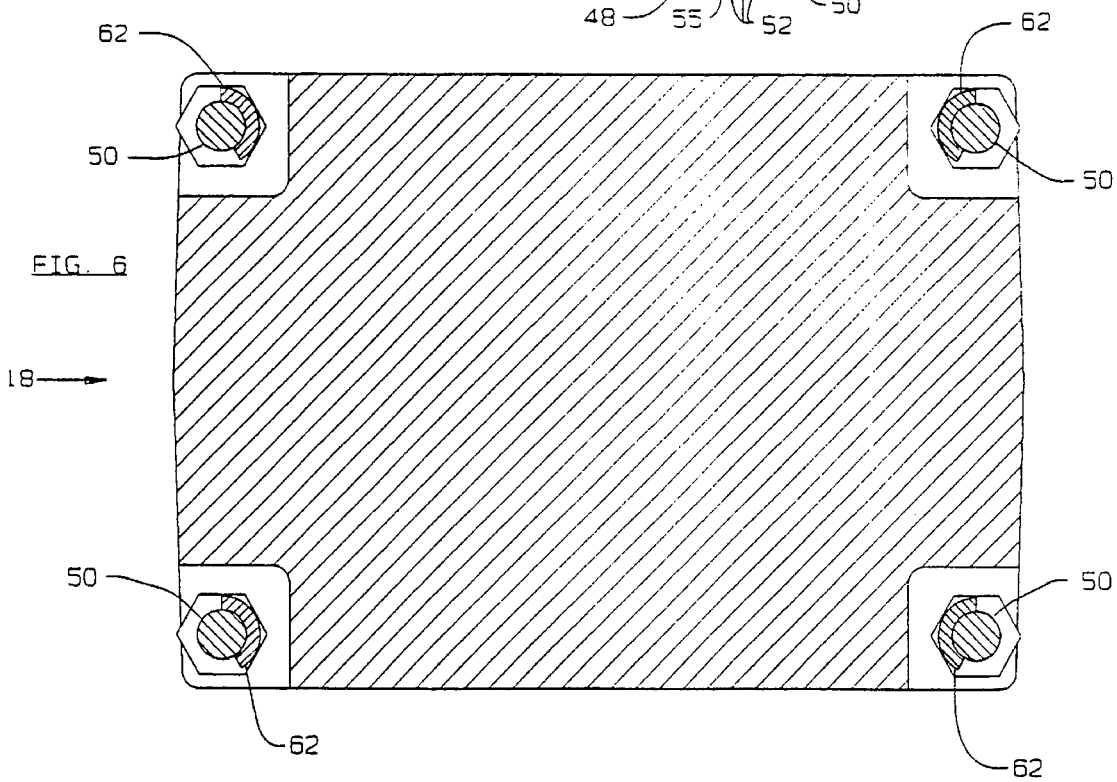
FIG. 6 is a sectional view taken along line 6—6 of FIG. 5.

As shown best in FIGS. 4–6, each cushioning unit 18 includes a rectangular front plate 42, a rectangular and elongate spacer block 44 and a preloaded stack 46 of resilient elastomer pads sandwiched between the plate and block. The front plate 42 includes front and rear surfaces 43 and 45 and a continuous body extending between the surfaces. Likewise, the block 44 includes front and rear surfaces 47 and 49 and a continuous body extending between the surfaces. The plate and block each include recessed corner ears 48 adjacent the stack with bores extending through the ears. Bolts 50 are fitted through the bores in ears 48 to sandwich and hold stack 46 between the plate and block. Block 44 is solid and serves as a spacer to fill a large portion of the length of standard dimension draft gear pocket 20 and is provided with a number of recesses to reduce manufacturing cost and weight.

Stack 46 includes a number of flat resilient elastomer pads formed from styrene-butadiene rubber of the type marketed under the trademark KEY-GARD by Keystone Industries, Inc., assignee of the present application. As illustrated in FIGS. 4 and 5, the stack 46 includes three flat metal mounting plates 52, with elastomer pads 54 mounted on each side of plates 52 and two flat metal mounting plates 55 with end mounting pads 56 mounted on one side of plates 55. Plates 55 are one-half the thickness of plates 52 and rest flush on the plate surface 45 and spacer block surface 47. The pads are generally rectangular in shape with cut-out corners to accommodate bolts 50. Each pad has a width of 8⅞ inches and a length of 12½ inches. The height of each pad is about 9/16 inches so that stack 46 with eight pads has a total uncompressed elastomer height of about 4½ inches. As illustrated, the pads are recessed to facilitate displacement of the elastomer when the stack is compressed.

The cushioning units 18 and follower blocks 58 in assembly 10 are held in pocket 20 between the front and rear stops 24 and 26. Each unit is positioned in a yoke 16 with spacer block 44 engaging the yoke heel 32 and the front plate 42 engaging a follower block 58. A concave spherical surface 60 is provided in block 58 and engages convex spherical surface 30 on adjacent drawbar butt end 14. Surface 60, like surface 30, is rough-cast and is not machined or otherwise smoothed. The roughness of surfaces 30 and 60 resists rotation of the butt end of the drawbar in the follower block, particularly when there is high loading between the drawbar and the follower block. Each end of the slackless drawbar assembly 10 is held up in a sill 22 by a pair of support plates 66 which are bolted to sill bottom flanges 68 as illustrated.

The cushioning unit is initially assembled in a press with the resilient stack 46 held between plate 42 and block 44 by bolts 50. The press is collapsed to compress the stack sufficiently so that the length the cushioning unit has an assembled length of about 22⅝ inches. Bolts 50 are tightened to hold the unit at this length against the partially compressed pad stack 46. Then the press is further collapsed to compress the stack further to allow four ½ inch 180° C.-shaped gags or shims 62 to be placed between the bolt heads and ears 48 of block 44 as shown in FIGS. 4–6. After the gags have been placed, the press is released and the pad stack expands to hold the gags tightly in place. The gags reduce the length of the cushioning unit to about 22⅛ inches to facilitate positioning the unit and block 58 in pocket 20. Block 58 is 2¼ inches long.

The assembly 10 is installed in two railcars by removing plates 66 from adjacent ends of the car sills, placing the gagged units 18 and blocks 58 in yokes 16 and raising each unit into a sill pocket 20 with the gagged units 18 and blocks located between stops 24 and 26. Blocks 58 are loosely confined between the front plates 42 and yoke ends 36. Plates 66 are then bolted to the sill flanges 68. The ends of drawbar 12 are then extended into the open sill ends and apertures 28 are aligned with bores 38 to permit extension of coupler pins 40 through the bores and apertures to secure the drawbar in place. When in this position, the spherical surface 30 on each drawbar butt end 14 is fitted in a concave spherical surface 60 on block 58.

After assembly 10 has been installed to join two railcars as described, the cars are placed in service. Initial buff or draft loading of the cushioning unit greater than the preload reaction force further compresses the stack, moves the heads of bolts 50 away from the gags 62 and allows the gags to fall away. When this happens, each stack expands to hold the cushioning unit 18 and block 58 between the front and rear stops 24 and 26 with a preload or reactive force of about 50,000 pounds, corresponding to position A of the graph shown in FIG. 7. In this position, bolts 50 are loose and do not restrict expansion of unit 18.

Pocket 20 is constructed according to American Association of Railroads specifications with a length, the distance between the front and rear stops, of 24⅝±⅛ inches. Cushioning unit 18 is designed so that when the unit and block are positioned between front and back stops, the stack is compressed to a reaction force of 50,000 pounds, corresponding to point A of the graph of FIG. 7. This relatively low preload prevents friction binding between surfaces 30 and 60. Binding could derail empty railcars. The actual preload of a unit 18 installed in a given pocket depends upon the actual distance between the front and rear stops in the pocket. This distance may be within the 24⅝±⅛ inches AAR specification or may be slightly longer due to sill stretch experienced prior to installation of the cushioning unit.

If the pocket suffers from sill stretch or is longer than the nominal design length of 24⅝ inches, then the installation preload or reaction force of the unit will be less than 50,000 pounds. If the length of the sill is at a minimum, per the AAR specification, the reactive force of the installed conditioning unit will be approximately 60,000 pounds, well below the force known to risk binding. The preload reactive force of the unit when installed in the pocket is close to 50,000 pounds and is not sufficiently great to cause derailments due to binding.

Figure 7:
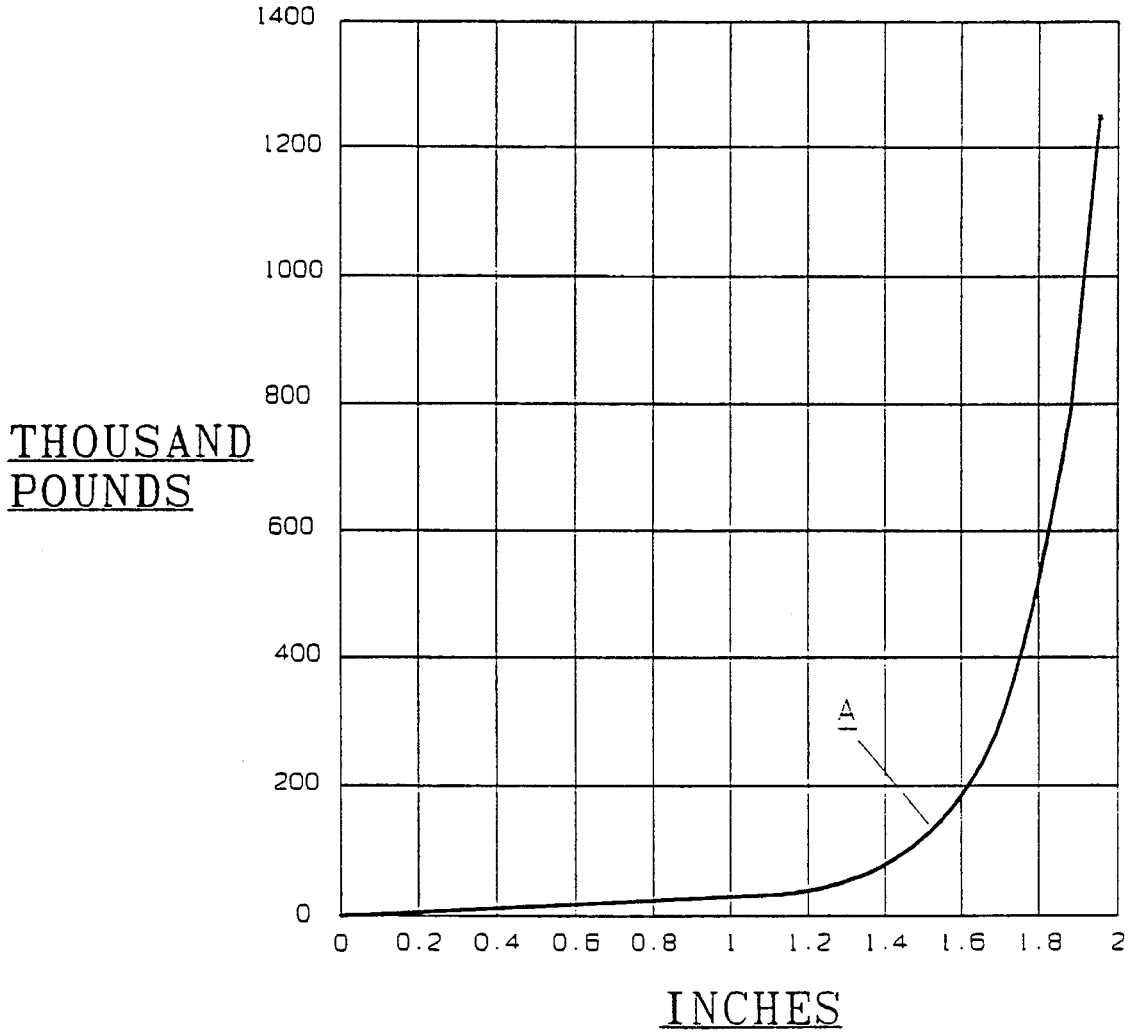
FIG. 7 is a graph showing the reaction force of one cushioning unit when shortened.

During normal service of the railcars connected by assembly 10, the assembly provides a slackless connection between the drawbar and each of the connected railcars. The elastomer pads in stack 46 act as an ultrahigh strength variable rate spring. When compressed, the reaction force builds very rapidly, as shown in the graph of FIG. 7 with limited collapse of the stack. When the force or shock exerted on the stack is dissipated, the collapsed elastomer quickly expands back to its initial geometry, thus re-extending the stack to its preload position between the stops and maintaining a slackless connection with the drawbar. The rapid re-expansion of the stack holds the follower block or pin against the butt end of the drawbar to prevent slack during return.

Figure 1:
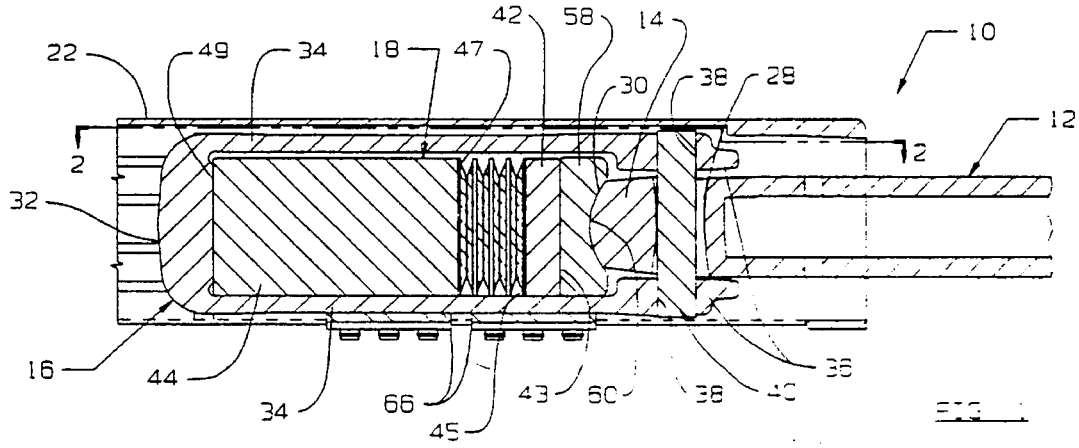
FIG. 1 is a vertical sectional view taken through one end of a slackless drawbar assembly per the invention mounted in the end of a sill of a railway car.
Figure 3:
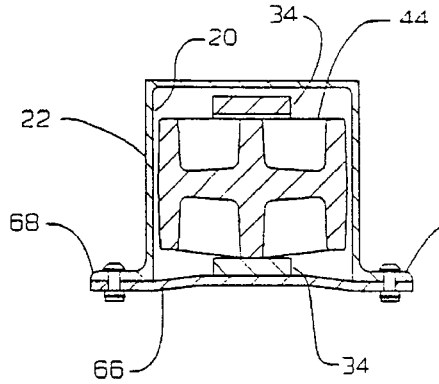
FIG. 3 is a sectional view taken generally along line 3—3 of FIG. 2.

FIG. 1 illustrates the position of one railcar when both joined railcars are traveling along a straight flat section of track. In this position, the adjacent butt end 14 of the drawbar is held between pin 40 and follower block 58 to eliminate slack. The end of the drawbar is snugly fitted in recessed block 58. The compressed pad stack 46 holds the cushioning unit and block between the stops 24 and 26 with a preload or reaction force of at about 50,000 pounds.

When the joined railcars travel around a horizontal curve, the drawbar end attached to the lead car pivots around the pin 40 at the connection with the railcar and the spherical surface 30 on the butt end 14 rotates in the concave surface 60 of the adjacent follower block 58 relative to the centerline of the car. Binding due to the rough cast surfaces is relieved by compression of unit 18. The resiliency of unit 18 greatly reduces increase in L and consequently in the L/V ratio to prevent derailment, even when the joined railcars are subject to severe buff loading.

If the track includes a vertical curve, each end of the drawbar is rotated up or down about a pin 40. Vertical plane rotation of the drawbar changes the pivot location or point of engagement between the butt end 14 of the drawbar and the pin 40. For instance, if the railcar with illustrated sill 22 is a lead car and moves along a track which curves up relative to the connected railcar, the sill 22 and components mounted in the sill rotate up about pin 40 relative to the drawbar 12 and the point of contact between the butt end 14 and pin 40 moves up to a point above the middle of pin 40. This rotation moves the lower portion of the butt end away from or inwardly from the pin, forces the follower block 58 and front plate 42 toward rear stops 26 and compresses pad stack 46. Compression of the pad stack increases the reactive force of the unit 18 to maintain the slackless connection without increasing the reactive force at the butt end—plate interface for empty railcars sufficiently high to bind the drawbar to the plate and cause a derailment. Unit 18 provides resiliency so that the lead end does not bind in the follower block and prevents the value of V from decreasing sufficiently to cause a derailment.

Likewise, when the trailing car of a pair of joined railcars moves down a vertical curve, the trailing butt end of the drawbar moves vertically in the follower block of the trailing car. The resiliency of unit 18 in the trailing end of assembly 10 prevents the value of V from decreasing sufficiently to cause a derailment.

When the railcars joined by assembly 10 are on the straight flat track and subjected to a high buff or draft load, the pad stacks 46 are collapsed to absorb the shock. The reactive force rapidly builds in response to the load to cushion the shock with minimum collapse. See the graph of FIG. 7. In normal operation, railcars are not subjected to loading shocks greater than about 270,000 pounds. Maximum draft and buff loadings anticipated between joined railcars is achieved with a short collapse length per stack of about 0.4 inches.

Test results show that stack 46 is capable of withstanding repeated loads or shocks of 1,250,000 pounds while retaining the low 50,000 pound preload. Further, the ability of the pad stacks to withstand 1,250,000 pound loads assures that railcars with slackless drawbar assemblies 10 installed meet the AAR requirement that railcar underframes withstand 1,250,000 pound loadings.

Empty railcars in a train of railcars may be derailed by binding in the conventional slackless drawbars of the wedge-type where the wedge has worked down to tighten the cushioning assembly between the front and rear stops, reducing the resiliency of the unit and increasing the reactive force of the unit. Train action in trains of unloaded railcars may then produce sufficiently large buff or draft loadings to cause derailments. The force applied at the drawbar-follower block interface may increase the lateral/vertical force ratio for the railcar, resulting in the end of the railcar becoming light and the wheel flanges riding up and over the rails. This problem is much less critical in trains with fully laden railcars because the weight of the railcars is considerably greater than the forces exerted on the butt end—follower block interface so that the L/V ratio is not increased.

The present invention eliminates the wedge and shims and assures that the preload on the cushioning unit is maintained at about 50,000 pounds, as previously described. Train action buff and draft loadings are insufficiently great to bind the butt end of the drawbar against follower block where the cushioning units are maintained at this low preload.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A slackless and wedgeless drawbar assembly for joining a pair of railcars of the type each having a sill at the end of the railcar and a pocket in the sill having front and rear stops attached to the sill, the assembly comprising, A) an elongate drawbar having opposed butt ends, each butt end defining a pin aperture and including a generally spherical surface;

B) a pair of cushioning units and a pair of follower blocks, one cushioning unit and one follower block adapted to be positioned in each pocket between the front and rear stops with the follower block adjacent the front stops and the cushioning unit adjacent the rear stops, each follower block including a generally spherical surface, each cushioning unit including a rear member having a rear member first surface adapted to engage the rear stops, a rear member second surface facing away from the rear member first surface and a rear member body extending continuously between such surfaces, a front member having a front member first surface engaging the follower block, a front member second surface facing away from the follower block and a second body extending continuously between such surfaces, and a compressed stack of elastomer pads sandwiched between said front and rear members and engaging said second surfaces, the stack including a plurality of metal plates interposed between adjacent ones of said elastomer pads;

C) a pair of yokes, each yoke surrounding a respective said cushioning unit and follower block and including a heel engaging the rear member first surface, straps extending from the heel past opposite sides of the cushioning unit and the follower block to a pair of spaced apart yoke ends, said ends defining a pair of pin bores, and a pair of coupler pins; and D) each drawbar butt end positioned between a respective pair of said yoke ends with the spherical surface of the butt end engaging the spherical surface of an adjacent follower block, and each coupler pin extending through a respective pair of pin bores and an aperture in the adjacent drawbar butt end.

2. An assembly as in claim 1 wherein in each cushioning unit the distance between the rear member first surface and the rear member second surface is fixed and the distance between the front member first surface and the front member second surface is fixed.

3. An assembly as in claim 2 wherein the elastomer pads are made from styrene-butadiene rubber.

4. An assembly as in claim 3 wherein each pad stack is compressed to a preload of about 50,000 pounds.

5. An assembly as in claim 4 wherein each pad stack has an uncompressed elastomer height of about 4½ inches.

6. An assembly as in claim 5 wherein the elastomer pads are rectangular in shape and each pad has a width of about 8⅞ inches and a length of about 12½ inches.

7. An assembly as in claim 6 wherein each pad stack includes about 8 said pads.

8. An assembly as in claim 4 wherein each pad stack has a reaction force of about 270,000 pounds when collapsed about 0.4 inches from-the 50,000 pounds preload length.

9. An assembly as in claim 2 wherein in each cushioning unit the distance between the rear member surfaces is greater than the distance between the front member surfaces and said front member comprises a plate.

10. An assembly as in claim 9 wherein said pads are comprised of styrene-butadiene rubber and each pad stack is compressed to a preload of about 50,000 pounds, and including plates between adjacent ones of said pads and a plurality of bolts joined to said front and rear members and extending past the pad stack, said bolts holding said members and pad stack together to form said cushioning units.

11. An assembly as in claim 10 including a plurality of gags, said gags shortening said bolts.

12. An assembly as in claim 10 wherein each pad stack has an uncompressed elastomer height of about 4½ inches and includes about 8 said pads.

13. An assembly as in claim 1 wherein said rear members each comprise a one piece spacer block.

14. A cushioning unit used in a reduced slack draw assembly of the type including a yoke joined to one end of a draw element and surrounding a follower block, the cushioning unit comprising, A) a spacer having a yoke surface, a first pad stack surface spaced from and facing away from the yoke surface, and a spacer body extending continuously between such surfaces so that such surfaces are spaced apart by a first fixed distance, a plate having a follower block surface, a second pad stack surface spaced from and facing away from the follower block surface and a plate body extending continuously between such surfaces so that such surfaces are spaced apart by a second fixed distance, said first distance being greater than said second distance, and a plurality of bolt apertures formed in said members adjacent said pad stack;

B) a compressed stack of elastomer pads sandwiched between said spacer and plate, said pads engaging said pad stack surfaces; and C) a plurality of bolts extending through said apertures in said spacer and plate, said bolts holding said spacer and plate together to form a unit and compressing the pad stack to a preload of at least about 50,000 pounds.

15. A cushioning unit as in claim 14 wherein the elastomer pads in the pad stack are made from styrene-butadiene rubber.

16. A cushioning unit as in claim 15 wherein the pad stack has an uncompressed elastomer height of about 4½ inches.

17. A cushioning unit as in claim 16, wherein the pad stack pads are rectangular in shape and each pad has a width of about 8⅞ inches and a length of about 12½ inches.

18. A cushioning unit as in claim 16 wherein each pad stack includes about 8 said pads and including plates between adjacent ones of said pads.

19. A cushioning unit as in claim 14 wherein said plate, spacer and pad stack are rectangular.

20. A cushioning unit as in claim 14 wherein said pad stack has a reaction force of about 270,000 pounds when collapsed about 0.4 inches from a 50,000 pounds preload length.

21. A cushioning unit as in claim 14, wherein said spacer body is unitary.

22. The combination of claim 14, including the follower block engaging said follower block surface; said yoke surrounding the cushioning unit and said follower block, the yoke including a heel engaging the yoke surface, a pair of straps extending from the heel past opposite sides of the cushioning unit and of the follower block to a pair of spaced apart yoke ends and pin bores in such ends; a slackless drawbar having a butt end positioned between said yoke ends, a drawbar surface engaging the follower block and a pin aperture; and a pin extending through said pin bores and pin aperture to join the drawbar to the yoke.

23. The method of mounting one end of a reduced slack draw assembly in a railcar of the type having a draftgear pocket at one end defined by front and rear stops attached to a sill, comprising the steps of:

A) placing a stack of elastomer pads between first and second members each having opposed surfaces spaced apart from each other by a fixed distance;

B) forming a cushioning unit by extending bolts through openings formed in the members and past the pad stack;

C) gagging the bolts to compress the pad stack and reduce the length of the cushioning unit;

D) positioning the gagged cushioning unit and a follower block in a yoke to form an assembly;

E) freely moving the assembly into the railcar pocket with the ends of the yoke facing the end of the railcar and the members freely spaced between the front and rear pocket stops;

F) securing the assembly in the railcar pocket;

G) moving one end of a reduced slack draw element into the end of the pocket and between the ends of the yoke and then attaching the end of the draw element to the ends of the yoke; and H) moving the end of the reduced slack draw element relative to the assembly in response to buff or draft loadings to further compress the gagged pad stack, release the gags from the bolts and permit the pad stack to expand so that the members resiliently engage the front and rear pocket stops with a preload force of about 50,000 pounds.

24. The method of claim 23 including the step of:

I) performing step H) by compressing the gagged pad stack by application of a force greater than about 50,000 pounds.

25. The method of claim 23 is made of styrene-butadiene rubber elastomer pads having an uncompressed height of about 4½ inches.

26. The method of claim 23 including the step of:

J) tightening the bolts to compress the pad stack to a preload of at least 50,000 pounds before performing step C.

* * * * *

UNITED STATES PATENT AND TRADEMARK OFFICE

CERTIFICATE OF CORRECTION

PATENT NO. : 5,598,937

DATED : Feb. 4, 1997

INVENTOR(S) : Marlin E. Clark

It is certified that error appears in the above-identified patent and that said Letters Patent is hereby corrected as shown below:

Column 1, line 59, change "There" to --These--.

Claim 1, line 21, change "follower block" to --front member first surface--.

Claim 25, line 1, after "23" insert --wherein the pad stack--.

Signed and Sealed this

Twelfth Day of August, 1997

Bruce Lehman

*Attest:*

BRUCE LEHMAN

*Attesting Officer*

*Commissioner of Patents and Trademarks*